US005648043A

United States Patent [19]

Mavropoulos et al.

[11] Patent Number: 5,648,043

[45] Date of Patent: Jul. 15, 1997

[54] BAFFLING SYSTEM FOR UNIFORMILY COOLING BILLET LOADS

[75] Inventors: Triantafyllos Mavropoulos, Montreal; Quingxian Jiao, Pierrefonds; Cesur Celik, Pointe-Claire, all of Canada; Bill McClelland, Dexter, Mo.

[73] Assignee: Noranda Inc., Toronto, Canada

[21] Appl. No.: 491,256

[22] Filed: Jun. 16, 1995

[51] Int. Cl.[6] ..... C21D 1/62

[52] U.S. Cl. ..... 266/259; 266/249

[58] Field of Search ..... 266/249, 259, 266/165; 432/148

[56] References Cited

U.S. PATENT DOCUMENTS

| | | | |
|---|---|---|---|
| 2,348,501 | 5/1944 | Scott | 266/259 |
| 4,068,516 | 1/1978 | Wonisch | 266/259 |
| 4,185,810 | 1/1980 | Eichenberger et al. | 266/259 |
| 4,591,338 | 5/1986 | Sahai et al. | 432/148 |
| 4,790,167 | 12/1988 | Gentry et al. | 72/257 |

OTHER PUBLICATIONS

Mavropoulos et al., *Computer Software in Chemical and Extractive Metallurgy*, Dec./1993, 319–331.

*Primary Examiner*—Scott Kastler

*Attorney, Agent, or Firm*—Fitzpatrick, Cella, Harper & Scinto

[57] ABSTRACT

The present invention is concerned with an adjustable baffling system for uniformly cooling billet loads of metal. The baffles have been design to adjust automatically to the load of billets after insertion of a car containing the billets thereon in the chamber, thus reducing the chances of having billet loads of uneven compositions. The present system is particularly useful for uniform cooling of aluminum billets.

13 Claims, 8 Drawing Sheets

BAFFLING SYSTEM FOR UNIFORMILY COOLING BILLET LOADS

FIELD OF THE INVENTION

The present invention is concerned with an adjustable baffling system which optimizes the air distribution in a cooling chamber containing a full or partial load of hot billets of metal.

BACKGROUND OF THE INVENTION

Aluminum alloyed billets are widely used for extrusion due to their very good extrudability, resistance to corrosion, and potential for precipitation hardening by heat treatment. The most common alloying elements are magnesium and silicon. As-cast billets, however, require homogenization in order to obtain the desired properties for extrusion.

A complete homogenization cycle of the billets comprises heating, homogenization or soaking, and cooling. Each individual component of the cycle is critical. Soaking of the billets needs special attention, and subsequent cooling is particularly sensitive. Soaking is taking place at a temperature range defined below the solidus line of the alloy and above the solvus temperature of the various solid phases.

Following the soaking step is the important cooling step, wherein the cooling rate of the billets is crucial, since the distribution and state of the alloying elements magnesium and silicon are influenced by the rate of cooling of the billets. Depending on the distribution and state of magnesium and silicon in the aluminum alloy, the surface quality, the extrusion rate and the extrusion load will vary, and the mechanical properties of parts obtained from the alloy may greatly differ. The optimum cooling rate is determined by the alloy composition desired. For instance, in the AA-6XXX series of aluminum alloys, high homogenization temperatures shift the $Mg_2Si$ precipitation curve to the right, thus making the alloy less quench sensitive, but transition elements like manganese, chromium, iron or zirconium move the precipitation curve to the left, and increase the quench sensitivity of the alloys. Consequently, it is a common practice in the art to add small amounts of manganese or chromium in the alloy, and quickly cool the billets from soak temperature to maximize the resistance of the balanced alloys.

The conventional manner to cool billets batchwise is to load them on a car or platform which is then placed in a cooling chamber wherein the billets are cooled by passing air therethrough with the help of exhaust fans suck. Although the air flow drawn by the fans is coming in the cooling chamber at a constant rate from the open side of the chamber, the billets at the centre of the load will obviously not be cooled at the same rate as those sitting close to the open side, since the temperature of the air increases as it progresses through the billets. The maximum variations in the cooling rate must therefore be maintained within a certain range, otherwise, as stated above, discrepancies will exist in the properties of the billets for a given load. The temperature difference between the front and back planes of the load is determined by the spacing between each row of billets, the fan capacity, the load capacity and the load configuration. On the other hand, the flow path of cooling air in the chamber depends on the load and the cooler geometry. In the event that the load is not symmetrical, significant variations of cooling rates would occur depending on the location of the billets in the car, as discussed in *Computer Software in Chemical and Extractive Metallurgy*, 1993, 319–331. The paper also suggests the use of baffles to optimize the air distribution during cooling. Although the mathematical model used and the plant data show that the baffles may be helpful in terms of optimizing the air flow, the reference is silent on the manner to lay the baffles above the billets, or the location, number or size of the baffles.

It would therefore be highly desirable to develop an adjustable baffling system to be installed in any conventional cooling chamber for providing a uniform cooling of billets, irrespective of the diameter of the billets or the configuration of the load, by uniformly dispersing air in the chamber.

SUMMARY OF THE INVENTION

According to the present invention, there is provided an adjustable baffling system for uniformly cooling loads of metal, preferably in the form of billets, the system comprising at least one baffle in the cooling chamber, the at least one baffle being perpendicular to air flow, and releasing means coupled to the at least one baffle for laying the at least one baffle above the billets after insertion of a car containing the billets in the cooling chamber, with the proviso that the space between a lower end of the at least one baffle and the billets is substantially the same as the space between two rows of billets. The present adjustable baffling system has been designed so that the at least one baffle adjusts automatically to the geometry and size of the load of billets, thus reducing the chances of having billets with uneven properties.

In a preferred embodiment, the at least one baffle is pivotally mounted on the ceiling of the chamber and maintained substantially flat against the ceiling, whereby after insertion of a car containing billets in the chamber, the releasing means is activated, by the car or otherwise, and the at least one baffle is pivoted and laid above the billets.

In a further preferred embodiment, the releasing means is a push bar which is coupled to the at least one baffle with at least one cable, whereby upon insertion of the car in the chamber, the push bar is pushed by the car thus releasing the tension in the at least one cable and causing the at least one baffle to be laid above the billets.

In a further preferred embodiment, if the number of baffles is higher than 1, a bar is pivotally mounted on each baffle perpendicularly thereto to form a baffle assembly.

IN THE DRAWINGS

DETAILED DESCRIPTION OF THE INVENTION

An adjustable baffling system designed to provide uniform cooling in homogenized metal billet loads, preferably aluminum, of different sizes is disclosed. Uniform cooling is achieved by optimizing the air flow through the load by means of adjustable ceiling baffles, and optional open side baffles, that reduce the amount of air bypassing the load when the space between the load and the walls of the cooling chamber or the space between rows of the load billets is too large. The top baffles are adjusted upon inserting the car into the cooling chamber. Side baffles may be manually or, preferably, automatically adjusted, if required.

As described above, cooling chambers for cooling billets of metals like aluminum are currently designed to operate optimally with full loads. When such full loads are present, the geometry of the load on the car is generally symmetrical. Accordingly, the cooling air flows also in a substantially symmetrical manner. However, in certain circumstances, only a fraction of a full load may need to be cooled, which results in several empty spaces in the cooling chamber. The present system has been designed to "fill" these spaces so that the path of the air flow is about the same as that if the load was completely filling the chamber. Therefore, the present system gives aluminum billets manufacturers greater flexibility in responding to the orders of their clients, and allows the reduction of inventory, since small orders can be handled quickly without sacrificing the quality of the billets.

The diameter of the billets may also cause the present system to be used even in chambers containing a full loads. Such use would be warranted because, depending on the billets diameter, the space between the last row of billets and the ceiling of the chamber may be to big, thus creating an excess of air flow thereby. The present system would therefore prevent such excess of air flow.

Figure 1:
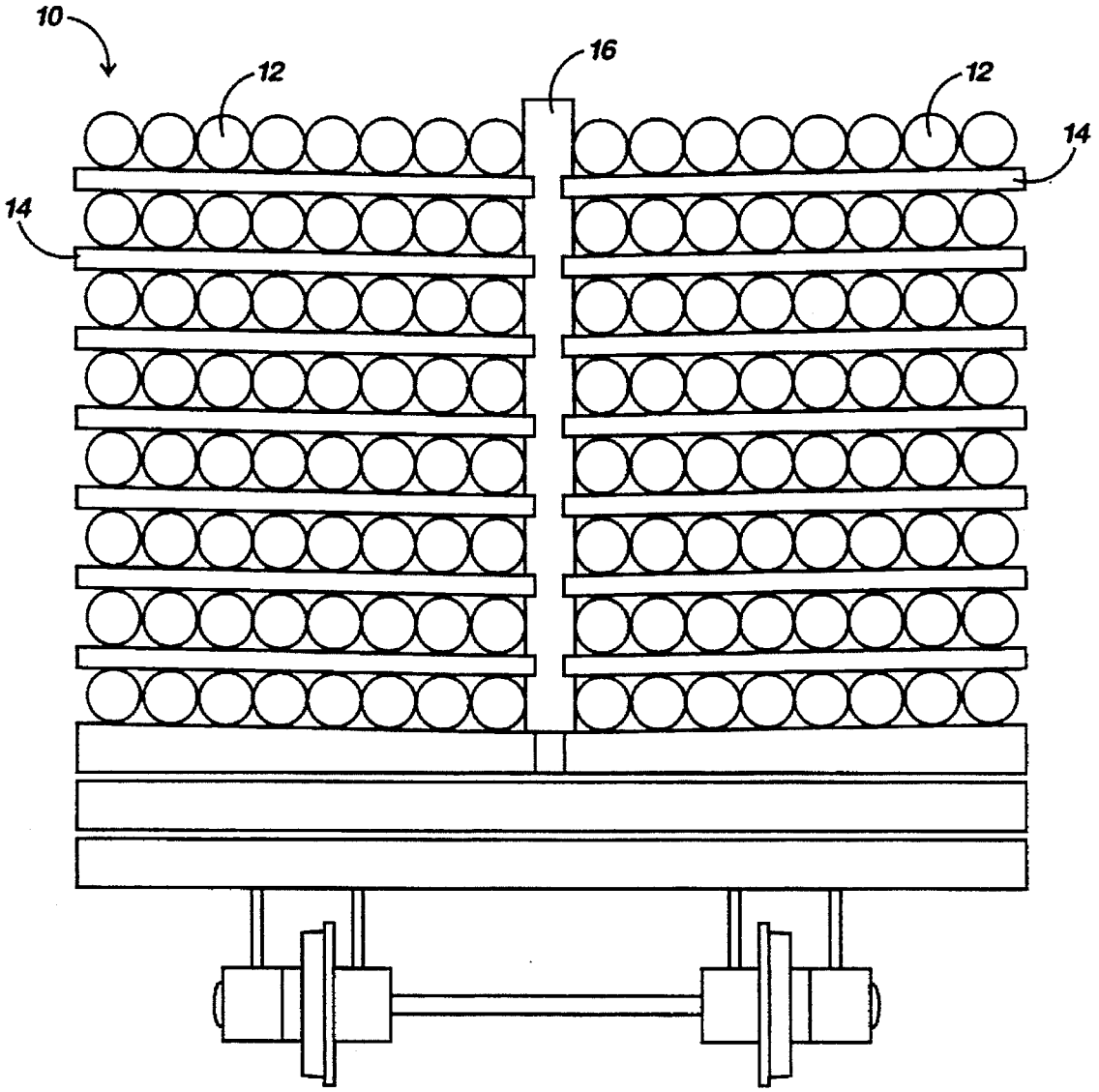
FIG. 1 illustrates an end view of a car containing a load of billets to be cooled in the cooling chamber.
Figure 2:
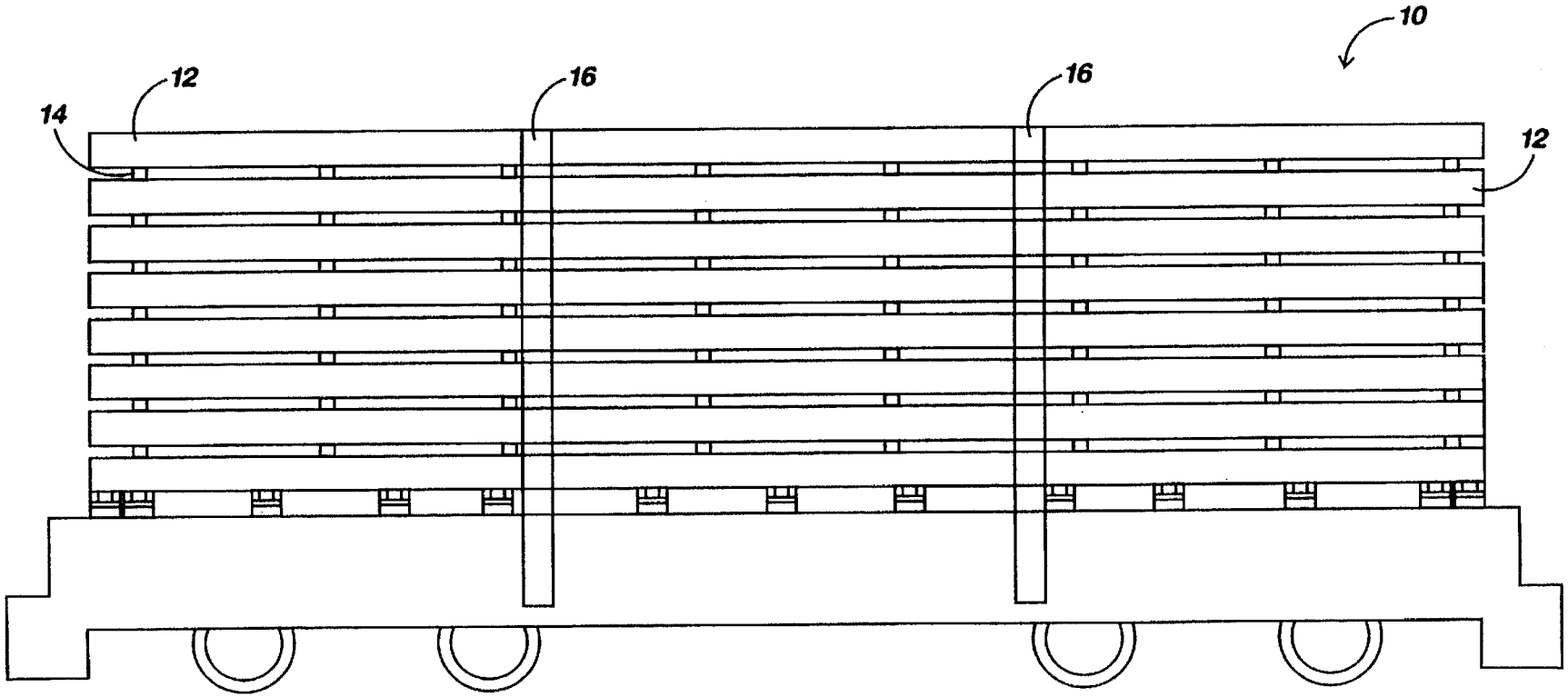
FIG. 2 illustrates a side view of the car and billets illustrated in FIG. 1.

The cooling chamber used to demonstrate the effectiveness of the present system is designed to cool aluminum billets of about 300 inches in length and 5–14 inches in diameter, disposed in load preferably weighing from 90,000 to 150,000 lbs/car. Such chambers are manufactured and sold by Seco/Warwick Corporation, Meadville, Pa. Referring to the drawings which illustrate preferred embodiments of the present invention, there is provided in FIGS. 1–2 a conventional transporting car 10 having a plurality of billets 12 placed on series of bars 14 used as spacers between the rows of billets 12. Bars 14 are slightly inclined towards two centered posts 16 to prevent billets 12 from falling on the ground. The number of billets making up a load is related to the billet diameter and the space occupied by the load. The presence of bars 14 thus allows cooling air to circulate between the billets.

Figure 3:
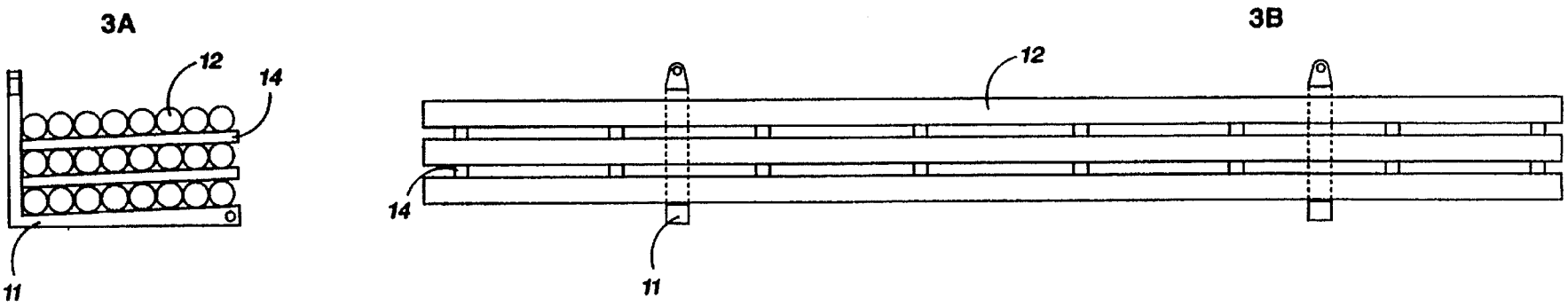
FIG. 3 illustrates L-frames used to load billets on a car.

Other arrangements of billets 12 are possible on car 10. For example, as illustrated in FIG. 3A, the billets may be disposed on an L-frame 11. Again, bars 14 are used as spacers. An advantage of this arrangement is that it accelerates loading and unloading operations of car 10, since L-frames can be easily picked up by a crane (not shown). FIG. 3B illustrates a side view of FIG. 3A. A given load on a car may therefore contain more than one L-frame 11 sitting on one another.

Figure 4:
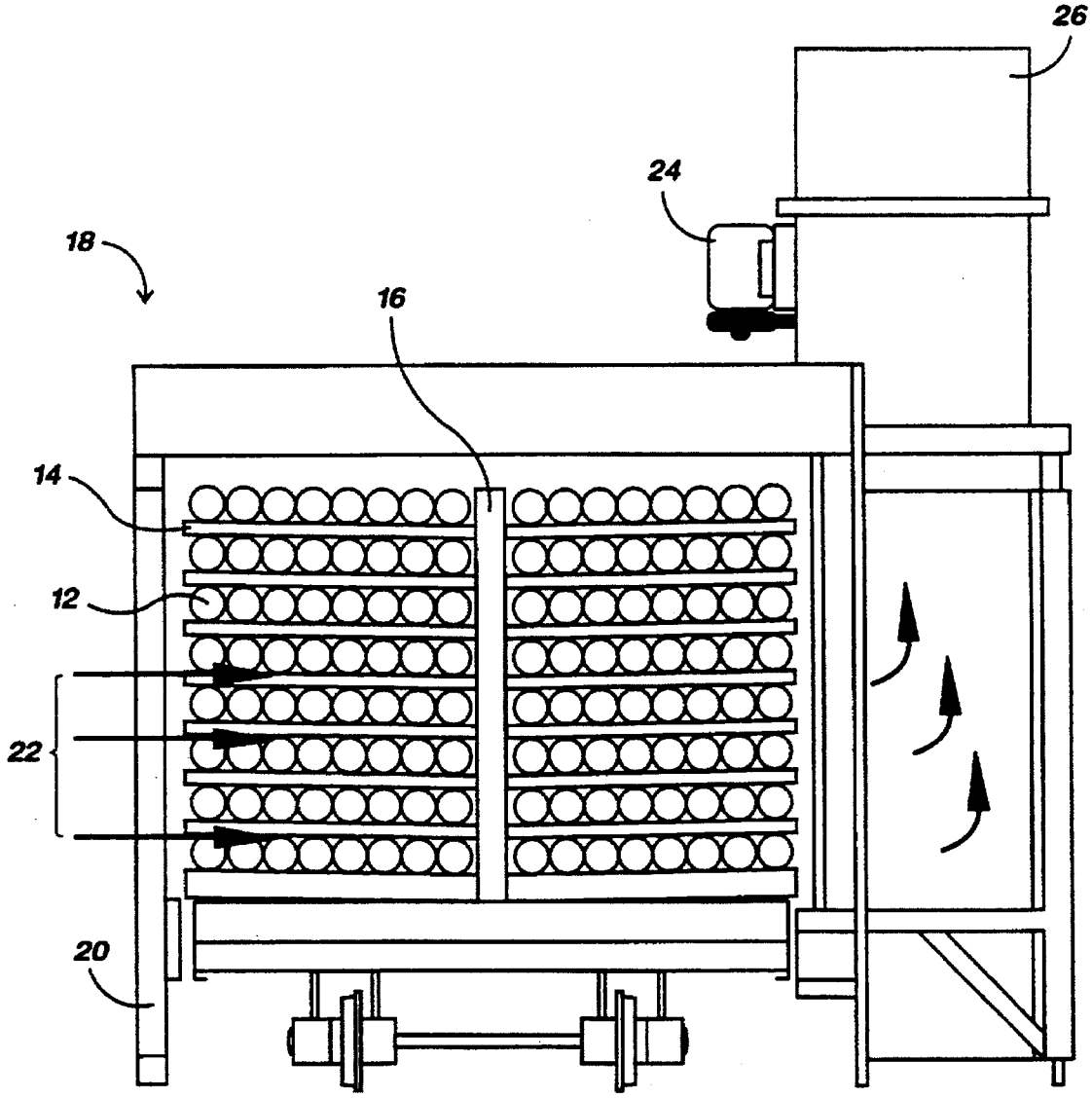
FIG. 4 illustrates an end view of the cooling chamber containing the car of FIG. 1.
Figure 6:
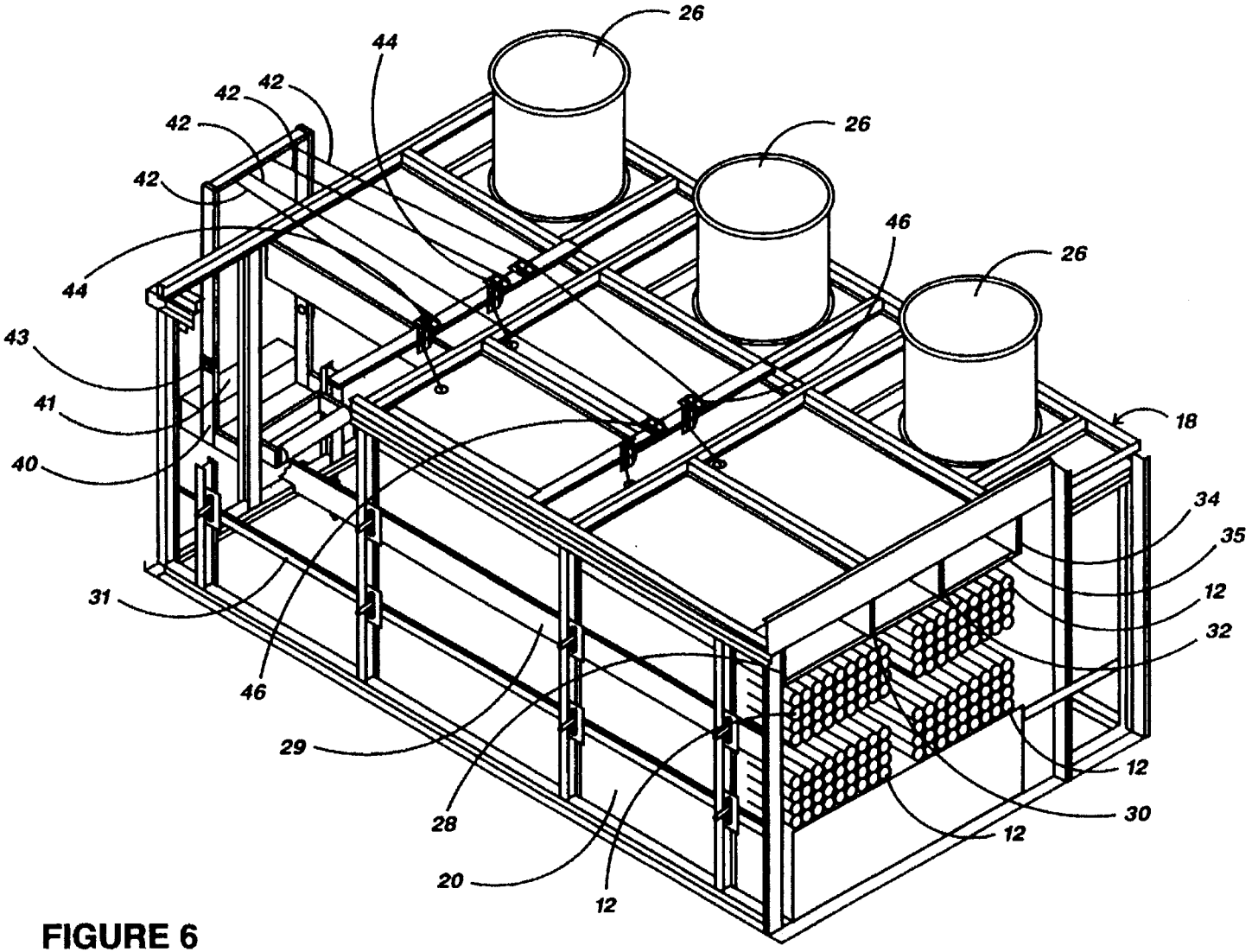
FIG. 6 illustrates a conventional cooling chamber containing the adjustable baffling system according to the present invention.

Car 10 is rolled from a homogenizing furnace (not shown) to cooling chamber 18, which is illustrated in FIGS. 4 and 6. Air is drawn from open wall 20, as indicated by arrows 22 in FIG. 4, through the billets, and out of chamber 18 by means of at least one exhaust fan 24 and a chimney 26. The cooling air flow is generally at room temperature when entering the chamber, but may be colder or warmer if necessary.

Figure 5:
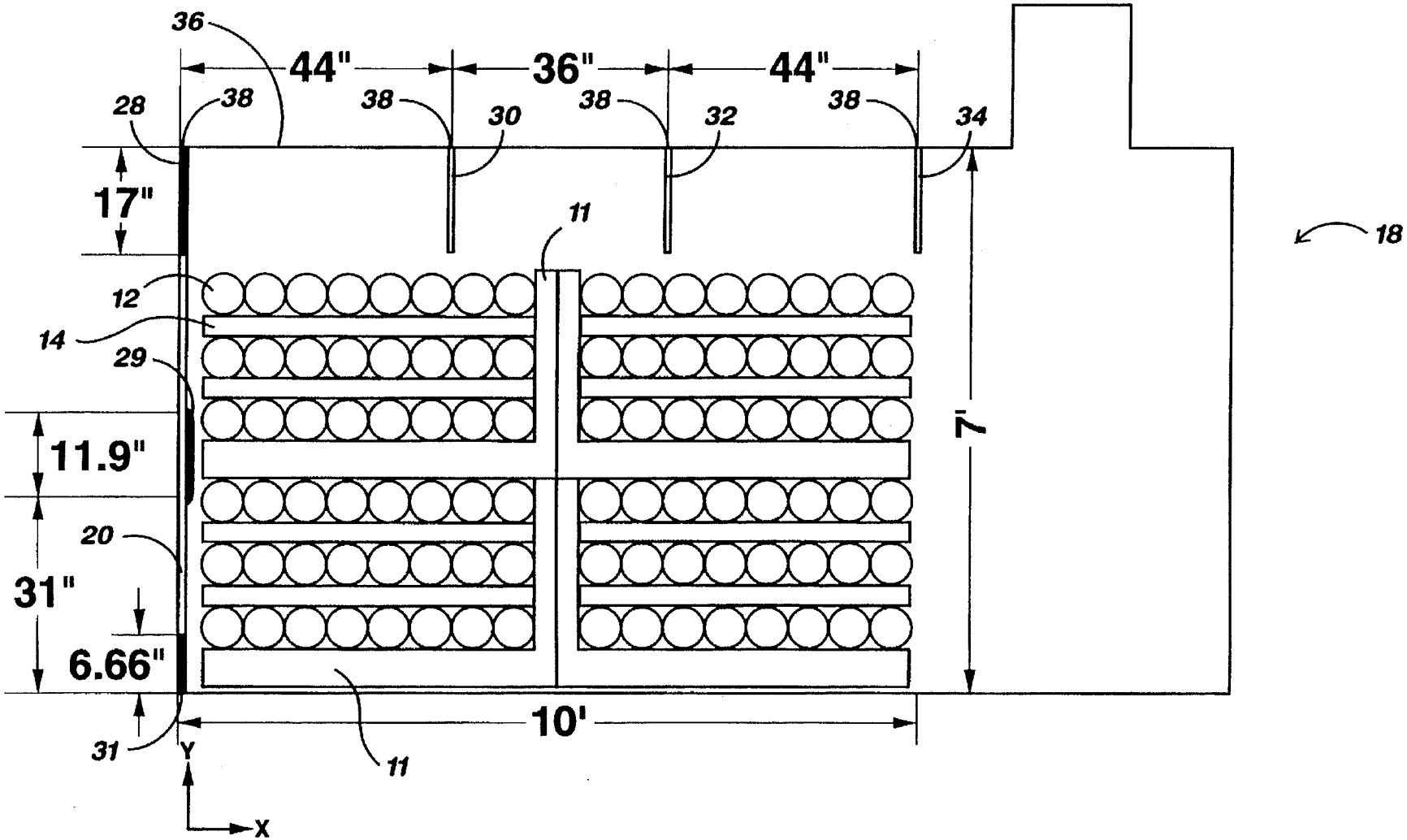
FIG. 5 is an expanded view of FIG. 4 showing the baffles in the cooling chamber.
Figure 8:
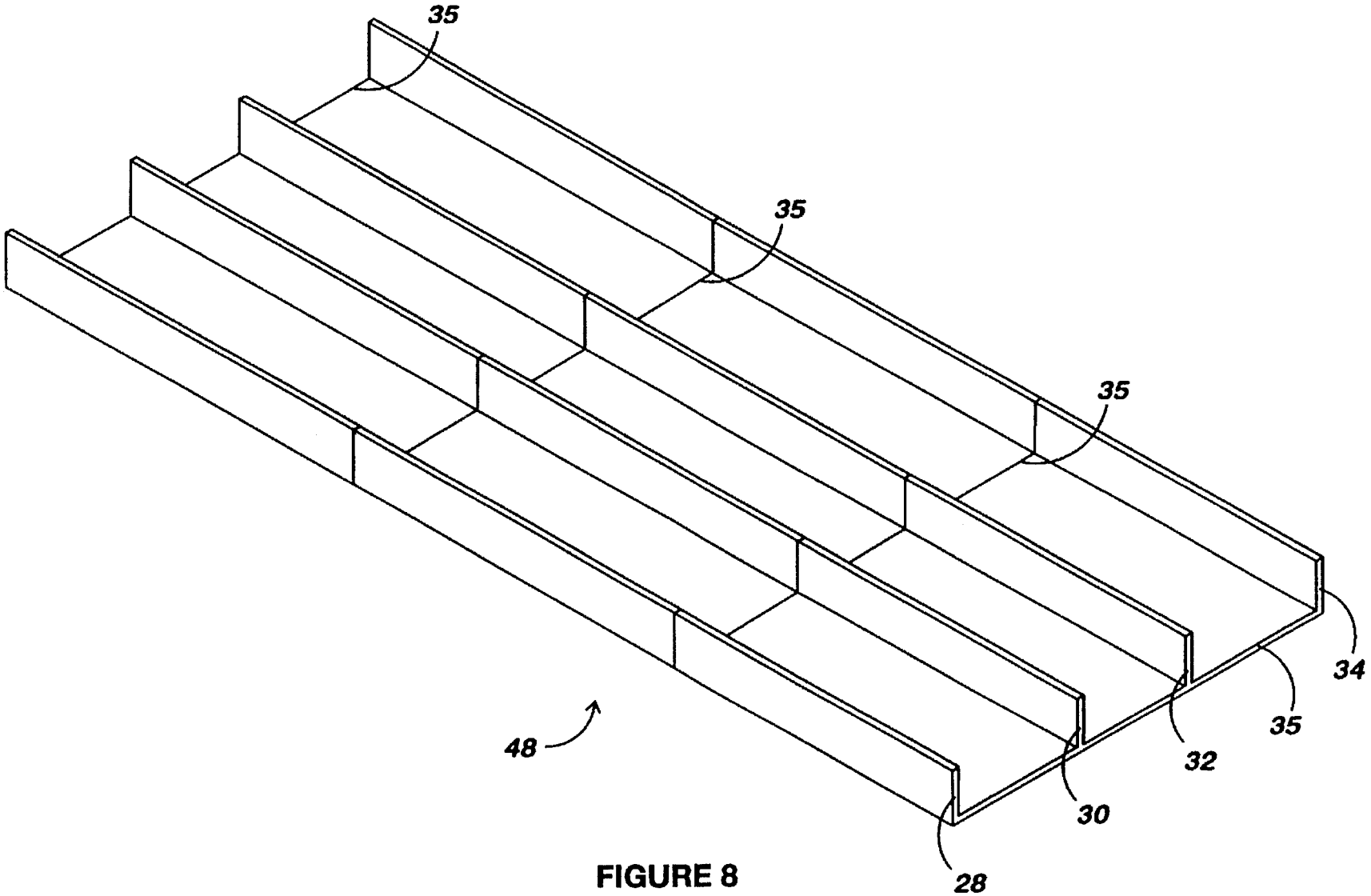
FIG. 8 illustrates the baffle assembly to be installed on the ceiling of the cooling chamber.

Referring to FIG. 5, it can be seen that baffles 28, 30, 32 and 34 have been positioned on the ceiling 36 of chamber 18. Baffles 28, 30, 32 and 34 extend along the length of chamber 18 and are each pivotally mounted at 38 to adjust to the height of the load of billets 12. 4 bars 35 are pivotally and perpendicularly mounted on each baffle (FIG. 8). The thickness of bars 35 is about the same as that of bars 14 so that when the baffles are lowered, the space between the billets and bars 35 is about the same as that between two rows of billets. This allows an even distribution of the air flow as it passes through the billets. FIG. 5 illustrates the most preferred distances between each baffle. Because of the presence of L-frames 11 for loading the billets, it is necessary to add baffles 29 and 31 on sidewall 20 to have a substantially uniform air flow path. Baffles 29 and 31 and can be adjusted vertically or horizontally.

In an alternative embodiment, instead of having the baffles pivotally mounted on the ceiling of the chamber, one may prefer to have the baffles resting on the top of the chamber. After insertion of the car in the chamber, the baffles would be laid above the billet load by lowering them through slots present in the ceiling of the chamber. The baffles may be lowered mechanically, for example with a push bar as described hereinbelow, electrically or otherwise.

Figure 7:
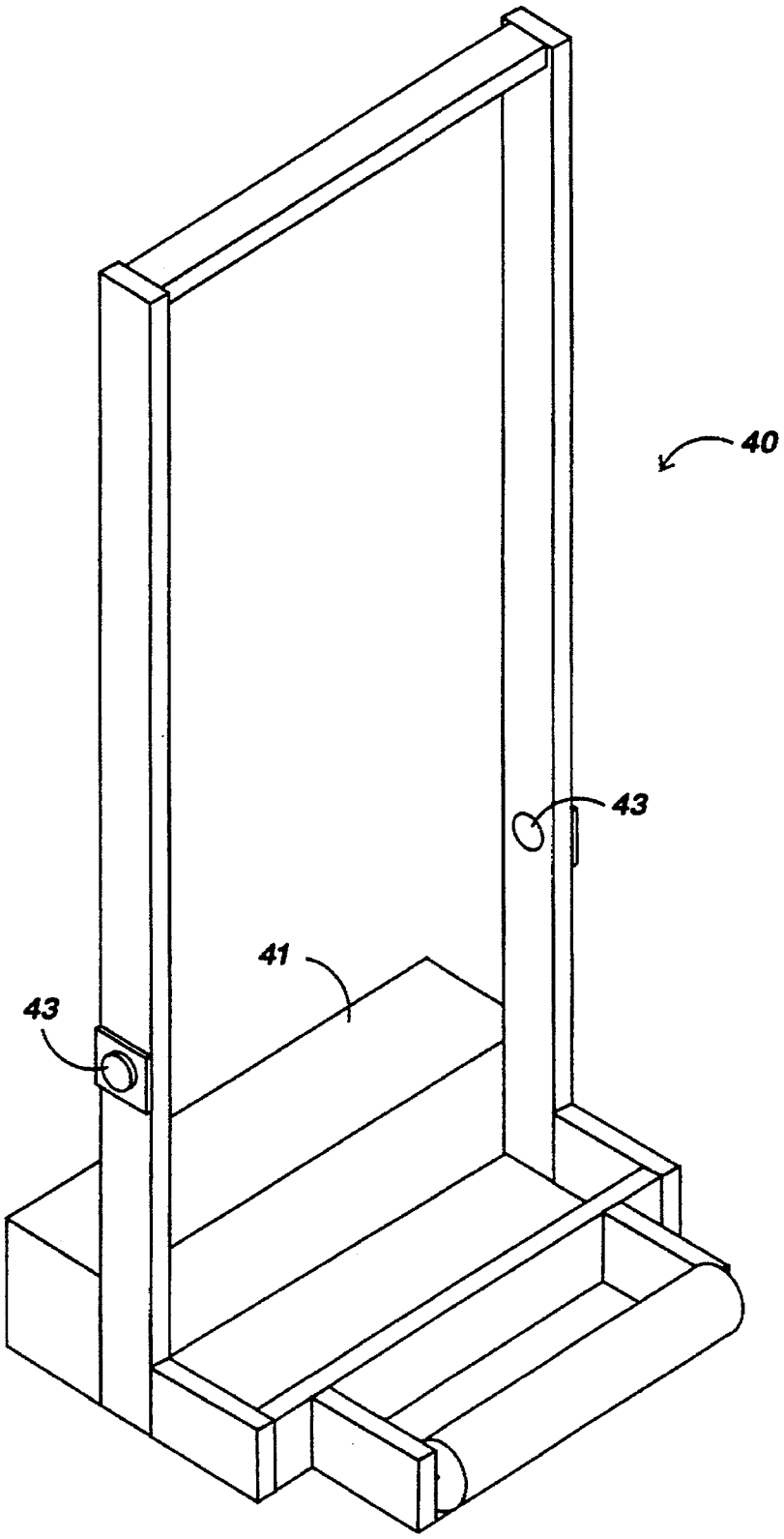
FIG. 7 illustrates the push bar developed for the adjustable baffling system.

FIG. 6 illustrates an elevated view of a cooling chamber equipped with the adjustable baffling system according to the present invention. The system is made of a push bar 40 (see FIG. 7) which is pushed by car 10 as it enters cooling chamber 18. The push bar contains a weight 41 and is pivotally mounted at 43 to the wall of cooling chamber 18. Cables 42 are attached at one end to push bar 40, pass through pulleys 44 and 46, and are attached at the other end to baffle assembly 48 (see FIG. 8) which is formed with baffles 28, 30, 32 and 34 and 4 bars 35, also pivotally mounted on the baffles, the latter being provided to solidify the assembly and to act as a spacer between the baffles and the billets, as stated above. When the cooling chamber is empty, weight 41 maintains push bar 40 in a position such that cables 42 are tight, thus maintaining baffles 28, 30, 32 and 34 substantially flat against ceiling 36 of chamber 18. As car 10 enters the chamber, it pushes push bar 40 which pivots, thus releasing the tension in cables 42. The release of the tension of the cables translates in the pivoting of the baffles until bars 35 touch the upper row of billets (FIG. 6), the maximum angle between the baffles and the ceiling being obviously 90°. When car 10 is removed, weight 41 forces push bar 40 to return to its original position, thus lifting baffles 28, 30, 32 and 34 to the horizontal position again. It should be noted that the width of baffles 28, 30, 32 and 34 can be varied at will. For example, if very small loads need to be cooled, longer baffles will be required.

The mechanism for pivoting and/or laying the baffles disclosed herein may be replaced by any automatic or manual releasing system. For example, the push bar and cables may be removed and replaced by an electromechanical or hydraulic device which makes the baffles pivoting after the car has entered the chamber. Such devices may also allow the lowering of the baffles through slots in the ceiling if the baffles are kept on the top of the cooling chamber, as described above.

The spacing of the billet rows is most preferably constant and determined by the size of bars 14 supporting the billets. Since spacing is the same everywhere, including that above the billets because of the presence of bars 35 between the baffles and the billets, the amount of air passing through each gap is substantially the same and the cooling rate at a given load location is therefore substantially the same also because the presence of the baffles allows a simulation of a full load of billets. It should be specified however that the cooling rate in every location of a given row is not the same because the cooling air is obviously becoming hotter as it passes through the load, thus creating a temperature difference (ΔT) between the front and back end of the load. The magnitude of this difference is determined by the size of the spacing between the rows of billets and the fan capacity used to draw the air through the load.

Once the billets are cooled, the baffles are withdrawn or pivoted away from the billets, and the latter may be transported with the help of L-frames (FIG. 3) and stored. Billets and spacer bars are placed on two steel L-frames and the assembly is transferred by a crane either to a new storage area or to a transport car loading area. Alternatively, the L-frames and centered posts may be eliminated, which leaves only the billets and the spacer bars on the car.

In the most preferred embodiment of the present invention, as illustrated in FIG. 6, the optimization of the air flow for billet loads smaller than a full load is achieved with the use of six baffles. The most preferred location of these baffles together with the maximum available load space can be seen in FIG. 5. In the cooling chamber illustrated, the dimensions of the baffles are chosen for treating loads from 100,000 to 150,000 pounds of billets. The top four baffles are automatically adjusted when the car is inserted in the cooler, and the remaining two at the open front phase of the cooler can be adjusted manually or automatically. The front phase middle baffle 29 may be adjusted ±10 inches up or down from the shown position, and up to 12 inches towards the load from the shown position. The lower front phase baffle 31 can be adjusted in the same manner as baffle 29.

The minimum load height is determined by the maximum width of the top baffles. Therefore, for practical reasons with the above described adjustable baffling system and for seven-inch diameter billets, the cooling chamber may treat equally well loads varying from 90,000 lbs. to 150,000 lbs. Obviously, the system can effectively and uniformly cool billets disposed otherwise. However, it is imperative that the billets be disposed in a regular manner to avoid possible "empty holes" which will cause a non-uniform air flow, and ultimately, non-uniform cooling causing inconsistency in the properties of the billets for a given load.

The number of baffles is also dependent on the disposition of the baffles on the car. In FIG. 5 for example, the presence of the L-frame requires 4 top baffles and three side baffles. If the L-frames and the centered posts are absent, the presence of baffles 28, 34 and 31 would probably be sufficient since the spaces taken by the L-frames would be filled with billets.

While the invention has been described in connection with specific embodiments thereof, it will be understood that it is capable of further modifications and this application is intended to cover any variations, uses or adaptations of the invention following, in general, the principles of the invention and including such departures from the present disclosure as come within known or customary practice within the art to which the invention pertains, and as may be applied to the essential features hereinbefore set forth, and as follows in the scope of the appended claims.

What is claimed is:

1. A system for automatically laying at least one baffle over a load of billets of metal contained in a cooling chamber for allowing the substantial uniform cooling thereof, the at least one baffle extending throughout the length of the chamber and being perpendicular to cooling air flow, the system comprising:

releasing means coupled to the at least one baffle for moving the at least one baffle to lay it above the billets, whereby upon insertion of a car containing the billets, the releasing means is activated and the at least one baffle is laid and automatically adjusted above the billets to insure substantial uniform dispersion of the cooling air flow, with the proviso that a space between an end of the laid at least one baffle and the billets is substantially the same as the space between two rows of billets.

2. A system according to claim 1 wherein the at least one baffle is pivotally mounted on the ceiling of the chamber and maintained substantially flat against the ceiling of the chamber when the chamber is empty, whereby upon insertion of the car, the releasing means is activated and the at least one baffle are pivoted and laid above the billets.

3. A system according to claim 1 wherein the releasing means is a push bar pivotally mounted on a wall of the chamber, the push bar being coupled to the at least one baffle with at least one cable.

4. A system according to claim 1 wherein the number of baffles is 4, and wherein at least one bar is pivotally mounted on each baffle perpendicularly thereto to form a baffle assembly.

5. A system according to claim 3 wherein the at least one cable passes through at least one pulley between the releasing means and the at least one baffle.

6. A system according to claim 1 further comprising at least one adjustable baffle located on at least one sidewall of the cooling chamber.

7. A system according to claim 1 wherein the billets are placed in rows, the rows being spaced from each other by a spacer.

8. A system according to claim 1 further comprising aluminum billets.

9. A system for automatically laying a baffle assembly containing two baffles over a load of billets of aluminum contained in a cooling chamber for allowing the substantial uniform cooling thereof, the system comprising:

a push bar pivotally mounted on a wall of the chamber;

at least one cable having one end secured to the push bar and the other end secured to the baffle assembly, wherein the at least two baffles extend throughout the length of the chamber and have one end pivotally mounted to a bar perpendicular thereto, the other end of the at least two baffles being pivotally mounted on the ceiling of the chamber, the at least two baffles being perpendicular to air flow and maintained substantially flat against the ceiling when the chamber is empty, whereby upon insertion of a car containing the billets, the car pushes and pivots the push bar to release tension in the at least one cable, and pivot and move the at least two baffles to lay them above the billets, with the proviso that the space between the end of the at least two baffles and the billets is substantially the same as the space between two rows of billets.

10. A system according to claim 9 wherein the at least one cable passes through at least one pulley inserted between the releasing means and the baffle assembly.

11. A system according to claim 9 further comprising at least one adjustable baffle located on at least one sidewall of the cooling chamber.

12. A system according to claim 9 wherein the number of baffles is 4.

13. A system according to claim 9 wherein at least one bar is pivotally mounted on each baffle perpendicularly.

* * * * *